US011906264B2

(12) United States Patent
Tasyagan

(10) Patent No.: US 11,906,264 B2
(45) Date of Patent: Feb. 20, 2024

(54) ADJUSTABLE FOREND MECHANISM IN RIFLES

(71) Applicant: Bahtiyar Tasyagan, Izmir (TR)

(72) Inventor: Bahtiyar Tasyagan, Izmir (TR)

( * ) Notice: Subject to any disclaimer, the term of this patent is extended or adjusted under 35 U.S.C. 154(b) by 0 days.

(21) Appl. No.: 17/594,733

(22) PCT Filed: Jun. 17, 2020

(86) PCT No.: PCT/TR2020/050522
§ 371 (c)(1),
(2) Date: Oct. 27, 2021

(87) PCT Pub. No.: WO2021/257013
PCT Pub. Date: Dec. 23, 2021

(65) Prior Publication Data

US 2022/0307794 A1 Sep. 29, 2022

(51) Int. Cl.
*F41C 23/14* (2006.01)
*F41C 23/16* (2006.01)

(52) U.S. Cl.
CPC ..... *F41C 23/14* (2013.01); *F41C 23/16* (2013.01)

(58) Field of Classification Search
CPC ..... F41C 23/14; F41C 23/16
See application file for complete search history.

(56) References Cited

U.S. PATENT DOCUMENTS

| | | | | |
|---|---|---|---|---|
| 9,939,225 | B2 * | 4/2018 | Ravnaas | F41C 23/22 |
| 10,352,644 | B2 * | 7/2019 | Ravnaas | F41C 23/22 |
| 10,480,891 | B2 * | 11/2019 | Eccleshall | F41A 23/08 |
| 10,488,132 | B2 * | 11/2019 | Full | F41A 11/04 |
| 10,508,885 | B1 * | 12/2019 | Kauffman, Jr. | F41C 27/16 |
| 10,514,231 | B1 * | 12/2019 | Hovey | F41C 23/04 |
| 10,704,859 | B2 * | 7/2020 | Pearce | F41B 11/62 |
| 10,845,158 | B2 * | 11/2020 | Mezynski | F41C 23/16 |
| 11,156,426 | B2 * | 10/2021 | Chia | F41C 23/16 |
| 11,320,226 | B2 * | 5/2022 | Roberts | F41C 23/16 |
| 2006/0010748 | A1 | 1/2006 | Stoner et al. | |
| 2018/0058794 | A1 * | 3/2018 | Scalf | F41A 23/08 |
| 2019/0093976 | A1 * | 3/2019 | Power | F16F 9/0218 |
| 2021/0180912 | A1 * | 6/2021 | Brauer | F41C 23/16 |
| 2022/0155041 | A1 * | 5/2022 | Aguacia Acosta | F41G 1/10 |
| 2022/0214130 | A1 * | 7/2022 | Roberts | F41A 23/04 |

FOREIGN PATENT DOCUMENTS

| | | |
|---|---|---|
| DE | 4422895 C1 | 10/1995 |
| GB | 2455833 B | 6/2009 |

OTHER PUBLICATIONS

International Search Report in International Application No. PCT/TR2020/050522 dated Mar. 15, 2021.
Written Opinion of the International Searching Authority in International Application No. PCT/TR22020/050522 dated Mar. 15, 2021.

* cited by examiner

*Primary Examiner* — Michelle Clement
(74) *Attorney, Agent, or Firm* — Phil IP Law Inc.; Narek Zohrabyan; Karen 'Kirk' Galoyan

(57) ABSTRACT

The invention relates to a forend (1) which can be used in all types of rifles and is adjustable according to the comfort of the user. The subject of the invention particularly relates to an improved design realized for the forend mechanism which can be adapted to the rifles such as bullpup, air rifles and firearms, can be adapted to any hand structure with its ergonomic structure.

3 Claims, 2 Drawing Sheets

ADJUSTABLE FOREND MECHANISM IN RIFLES

TECHNICAL FIELD

The invention relates to a forend which can be used in all types of rifles and is adjustable according to the comfort of the user. The subject of the invention particularly relates to an improved design realized for the forend mechanism which can be adapted to the rifles such as bullpup, air rifles and firearms, can be adapted to any hand structure with its ergonomic structure.

PRIOR ART

Today, in the rifles used, it is required to keep the rifle in a fixed balanced manner by the user in order to make proper shooting. While the user uses his/her one hand for pulling the trigger, the other hand holds the forend which is located in the bottom portion of the rifle in order to balance the rifle. The ergonomics of the forend is very important for the user. The forend which is located on the body of the rifle and facilitates holding the rifle in the direction of the target is designed in different sizes for the rifles that have different dimensions.

In the state of the art, according to the user portfolio; for example, a person with a short finger has difficulty in grasping the forend due to its size. Similarly, in the opposite situation, a person who has long fingers has difficulty in grasping the forend. This situation violates the safety of the other use, deviations occur in the direction of target shooting.

Furthermore, in the state of the art, the heat occurred in the barrel during serial shots also leads to heating the forend. As a result of heating the forend, this bothers the hand of the user that he/she handles and also gives harm to the same Moreover; this problem seen in holding prevents the desired shooting target to be fulfilled.

Consequently, it is required to make R&D studies and to produce forends which have an important place in all types of guns in order to eliminate the abovementioned disadvantages and bring solution to the existing problems.

Aim of the Invention

The present invention relates to an adjustable forend to be used in all types of rifles which is designed such that it can eliminate all disadvantages in the state of the art.

The main aims of the invention are as follows.

- The inventive adjustable forend has a structure which can be adapted to all types of rifles.
- The user may grasp the forend easily by bringing the same to an appropriate position to the finger and palm of the user with the adjustable structure of the forend.
- It allows the user to maintain the shooting direction, such that the rifle is kept in a balanced manner, while shooting the rifle.
- It provides comfort of use to the user during firing.
- The inventive adjustable forend provides a user-specific usage structure with its semi-moving structure.
- In the heats generated depending on shooting in the barrel, the user is prevented from suffering damage by moving the forend away from the barrel with the semi-movable structure of the forend.

SUMMARY

In accordance with an aspect of these disclosures, there is provided an adjustable forend mechanism, including at least on forend lock, wherein one end of the forend lock may be exposed outside of a casing and the other end may have a cylindrical structure. A point may be located on the casing and at least one lock nail may be formed on a bottom surface of the forend lock. At least on lock spring may be engaged with the cylindrical structure of the forend lock and at least one lock wedge may be located behind the at least one lock spring and may be fixed on the casing. At least one adjustable forend may also have at least one lock gear on its inner surface.

The adjustable forend mechanism may have forend lock which may be engaged with the casing at the point and may have the forend lock which may be engaged with the casing at the point.

The adjustable forend mechanism may also be engaged with the forend lock at the point and may have the lock gear which may have at least two threads.

DETAILED DESCRIPTION OF THE INVENTION

The inventive adjustable forend mechanism shall be evaluated according to the following figures in order to better understand the improvements made for reaching the abovementioned aims.

In these figures.

Figure 1:
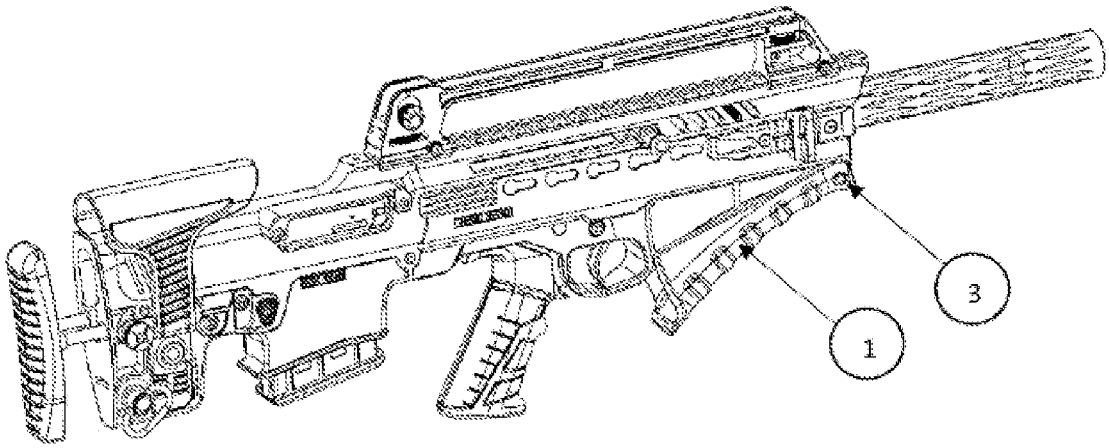
FIG. 1 is the general view of a rifle having the inventive adjustable forend mechanism structure.

Numbers are put on the figures in order to make the inventive adjustable forend mechanism to be understood better. Accordingly;

1. Adjustable forend
2. Forend lock
3. Forend pin
4. Lock spring
5. Lock wedge
6. Lock wedge pin
7. Lock nail
8. Lock gear
9. Casing
10. Thread
11. Casing channel
12. Adjustable forend pivot point
13. Forend lock channel The general view of the inventive adjustable forend mechanism in an example rifle is given in FIG. 1. The adjustable forend mechanism which can be applied to all rifles such as firearms, air rifles and bullpups consists of the following elements; adjustable forend (1), forend lock (2), forend pin (3), lock spring (4), lock wedge (5), lock wedge pin (6), lock nail (7), lock gear (8), casing (9), thread (10), casing channel (11), adjustable forend pivot point (12), and forend lock channel (13).

The adjustable forend (1) is fitted on the outer part of the casing (9). The forend lock (2), lock spring (4) and the lock wedge (5) are placed in the internal section of the casing (9). The casing (9), the adjustable forend (1) and the forend lock (2) are engaged with each other by means of a forend pin (3). The forend pin (3) first is inserted into one side of the adjustable pivot forend pivot (12) and then into the casing channel (11), and through the forend lock channel (13). The forend lock (2) is fixed into the casing (9) by means of the forend pin (3) such that one portion of the same is outside the casing (9); the adjustable forend (1) can be able to make angular movement about the casing channel (11) where the forend pin (3) is engaged on the casing (9).

Figure 2:
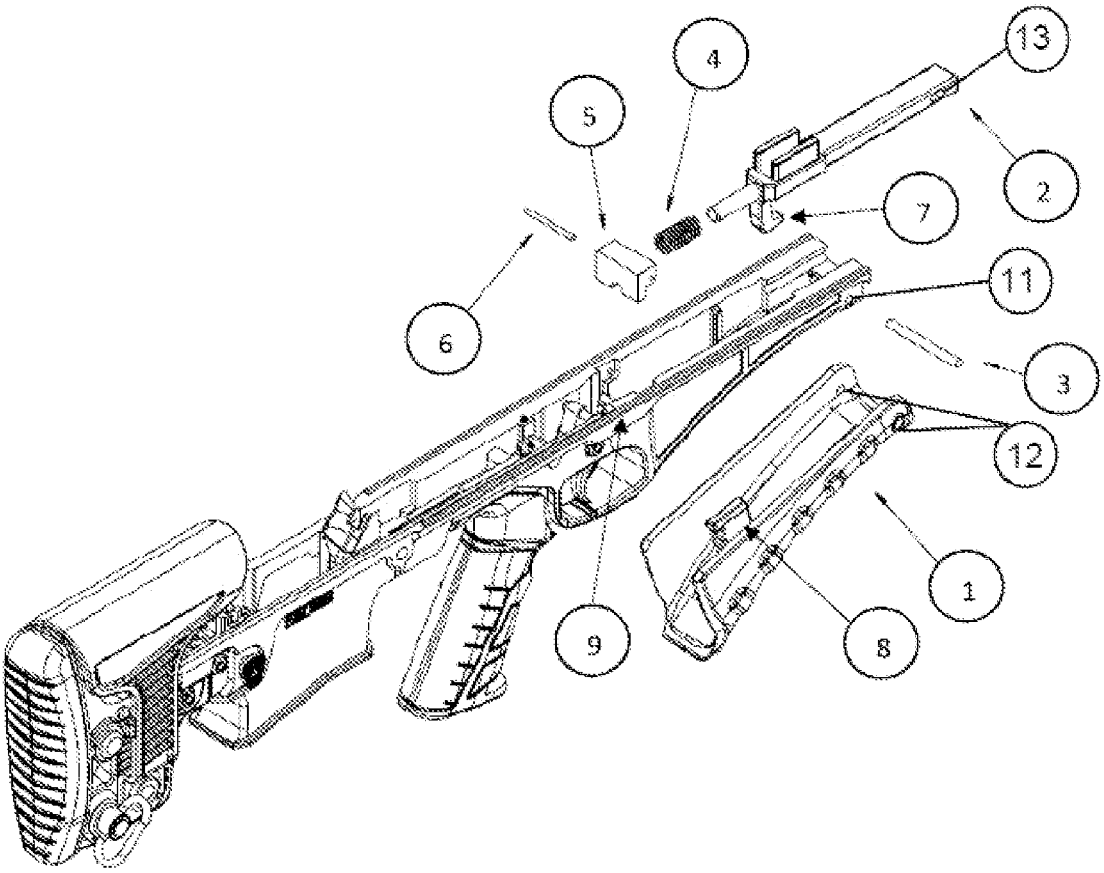
FIG. 2 is the internal mechanism view of the inventive adjustable forend mechanism.

While the forend pin (3) is passed from one end of the forend lock (2), the lock spring (4) is passed on the other end which has a cylindrical structure. At the end of the forend lock (2) to which lock spring (4) is fitted, a lock wedge (5) is positioned. The lock wedge pin (6) is passed through the lock wedge (5) and the lock wedge (5) is enabled to be fixed in the casing (9). (FIG. 2)

Figure 3:
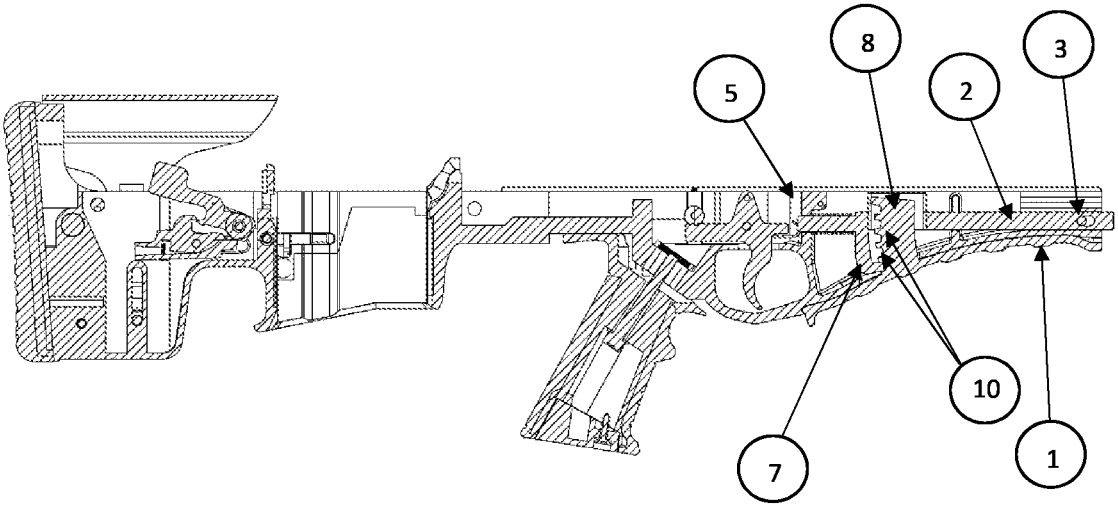
FIG. 3 is the sectional view of the inventive adjustable forend mechanism in a completely closed position.
Figure 4:
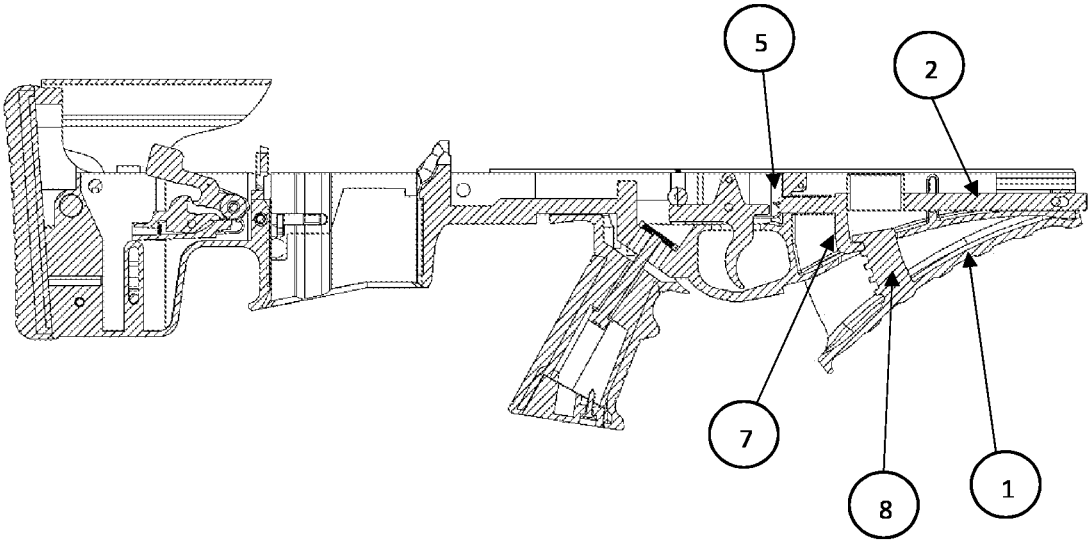
FIG. 4 is the sectional view of the inventive adjustable forend mechanism in a completely open position.

The lock gear (8) is formed on the inner surface of the adjustable forend (1). The lock nail (7) which is formed at the bottom portion of the forend lock (2) is seated between two threads (10) of the lock gear (8) and thus the adjustable forend mechanism is locked. If the lock nail (7) is inserted between the threads (10) located at the lowest portion of the lock gear (8), the adjustable forend mechanism is brought to the closed condition as can be seen in FIG. 3. If the lock nail (7) is inserted between the threads (10) located at the top portion of the lock gear (8), the adjustable forend mechanism is brought to the open condition as can be seen in FIG. 4. The position of the lock nail (7) and thus the position of the forend mechanism can change depending on the number of threads (10) on the lock gear (8) and the user can adjust the same according to his/her own comfort.

If it is required to describe the operation principle of the adjustable forend mechanism respectively; first of all, the user presses on the forend lock (2), of which one portion is outside the casing (9), with any finger while the user is holding the adjustable forend (1). As a result of this pressure applied, the forend lock (2) moves towards the butt of the rifle. The lock spring (4) which is fitted on the cylindrical structure on the rear portion of the forend lock (2) with this movement of the forend lock (2) rests on the lock wedge (5). In other words, the movement of the forend lock (2) in the butt direction terminates in the lock wedge (5). Thus, the lock nail (7) formed on the bottom section of the forend lock (2) moves in the same amount with the forend lock (2), is released between two threads (10) located on the lock gear (8). Therefore, the user can be able to adjust the adjustable forend (1) according to his/her hand ergonomics by means of moving the same in an upward or downward direction. When the adjustable forend (1) comes to the position required by the user, the user removes his/her finger from the forend lock (2) on which he/she presses, provides the forend lock (2) and thus the lock nail (7) to move towards the barrel section. The lock nail (7) which begins to move towards the barrel section, sits between two threads (10) corresponding on the lock gear (8) in the position required by the user. Therefore, the location of the adjustable forend (1) can be adjusted according to the hand ergonomics of the user and comfort of use.

What is claimed is:

1. An adjustable forend mechanism comprising:

at least one forend lock, wherein one end of the forend lock is exposed outside of a casing and the other end has a cylindrical structure;

at least one lock nail which is formed on a bottom surface of the at least one forend lock;

at least one lock spring which can be engaged with the cylindrical structure of the at least one forend lock;

at least one lock wedge which is located behind the at least one lock spring and is fixed on the casing through at least one lock wedge pin;

at least one adjustable forend which has at least one lock gear on its inner surface;

a forend lock channel located on the at least one forend lock;

at least one adjustable forend pivot point located on the at least one adjustable forend;

a casing channel located on the casing, wherein the forend lock channel, the at least one adjustable forend pivot point, and the casing channel are aligned together; and a forend pin located in the aligned the forend lock channel, the at least one adjustable forend pivot point, and the casing channel.

2. The adjustable forend mechanism of claim 1, wherein the adjustable forend is pivotally engaged with the casing.

3. The adjustable forend mechanism of claim 1, wherein the at least one lock gear has at least two threads.

* * * * *